US011465789B2

(12) United States Patent
Thurston

(10) Patent No.: US 11,465,789 B2
(45) Date of Patent: Oct. 11, 2022

(54) METHODS FOR CREATING SEALED PACKAGES USING DIMPLED FILMS

(71) Applicant: Larry R. Thurston, Pelzer, SC (US)

(72) Inventor: Larry R. Thurston, Pelzer, SC (US)

( * ) Notice: Subject to any disclaimer, the term of this patent is extended or adjusted under 35 U.S.C. 154(b) by 6 days.

(21) Appl. No.: 17/044,758

(22) PCT Filed: Apr. 8, 2019

(86) PCT No.: PCT/US2019/026377
§ 371 (c)(1),
(2) Date: Oct. 1, 2020

(87) PCT Pub. No.: WO2019/195845
PCT Pub. Date: Oct. 10, 2019

(65) Prior Publication Data

US 2021/0039814 A1 Feb. 11, 2021

(51) Int. Cl.
*B65B 11/52* (2006.01)
*B65B 31/02* (2006.01)
(Continued)

(52) U.S. Cl.
CPC ..... *B65B 11/52* (2013.01); *B65B 31/024* (2013.01); *B65B 45/00* (2013.01); *B65B 47/02* (2013.01); *B65B 2220/24* (2013.01)

(58) Field of Classification Search
CPC ..... B65B 11/50; B65B 11/52; B65B 11/54; B65B 31/02; B65B 31/024; B65B 45/00; B65B 47/02; B65B 2220/24
(Continued)

(56) References Cited

U.S. PATENT DOCUMENTS 3,247,643 A * 4/1966 Bartelt ..... B65B 11/52 53/509
3,377,770 A * 4/1968 Rorer ..... B65B 11/52 53/509
(Continued)

FOREIGN PATENT DOCUMENTS

DE 2402977 A1 * 7/1975 ..... B65B 11/52
DE 2622626 A1 * 12/1977 ..... B65B 11/52
(Continued)

OTHER PUBLICATIONS

International Search Report and Written Opinion for International Application No. PCT/US2019/026377 dated Jul. 9, 2020.

*Primary Examiner* — Stephen F. Gerrity
(74) *Attorney, Agent, or Firm* — Dale J. Ream

(57) ABSTRACT

Methods, apparatuses and systems for sealed dimpled film packages. A vacuum box having apertures, a dimpled bottom film sheet is placed on the base plate and an item to be packaged can be placed on the bottom dimpled film sheet. A top film sheet in a clamp frame is heated to a processing temperature and lowered towards the item and dimpled bottom film sheet. Vacuum suction causes sealing of the clamped top film sheet against the package from the base to the perimeter extending at an angle more than 5 degrees. The top film sheet is pulled down using the vacuum suction into contact with the dimpled film sheet from the base perimeter on the dimpled film sheet outward toward the perimeter of the dimpled film sheet forming a seal.

10 Claims, 12 Drawing Sheets

(51) Int. Cl.
*B65B 45/00* (2006.01)
*B65B 47/02* (2006.01)

(58) Field of Classification Search
USPC ..... 53/427, 433, 509, 511
See application file for complete search history.

(56) References Cited

U.S. PATENT DOCUMENTS

| | | | | | |
|---|---|---|---|---|---|
| 3,501,886 | A | * | 3/1970 | Watts, Jr. et al. | B65B 51/10 53/427 |
| 3,828,520 | A | * | 8/1974 | Merritt | B65B 11/52 53/427 |
| 3,830,365 | A | | 8/1974 | Krueger et al. | |
| 3,861,529 | A | * | 1/1975 | Coleman | B29C 51/12 53/427 |
| 3,895,475 | A | | 7/1975 | Wolfelsperger | |
| 3,910,008 | A | * | 10/1975 | Johnson | B65B 31/02 53/509 |
| 4,575,991 | A | * | 3/1986 | Hollingsworth | B65B 11/52 53/427 |
| 3,412,183 | A | | 11/1988 | Anderson et al. | |
| 7,665,280 | B2 | * | 2/2010 | Youell, Jr. et al. | B65B 11/52 53/427 |
| 7,807,253 | B2 | | 10/2010 | Kannankeril | |
| 2004/0050745 | A1 | | 3/2004 | Lee et al. | |

FOREIGN PATENT DOCUMENTS

| | | | | | |
|---|---|---|---|---|---|
| GB | 963377 | A | * | 7/1964 | B65B 11/52 |
| GB | 2075949 | A | * | 11/1981 | B65B 11/52 |

* cited by examiner

METHODS FOR CREATING SEALED PACKAGES USING DIMPLED FILMS

TECHNICAL FIELD

The subject matter disclosed herein relates to dimpled films, templates for forming dimpled films and related methods. In particular, the present subject matter relates to a films on which dimples have been formed using a template in a vacuum box that can be used to form a packages.

BACKGROUND

Packaging is the technology of enclosing or protecting items, remains, or products for transport, distribution, storage, sale, and/or use. Packaging material can come in a wide range of structures, sizes and material. One objective of most types of packaging is providing physical protection from hard contact, heat, cold, compression, and other mechanical or electrically shock. Another objective of many types of packaging is providing barrier protection from chemical exposure, oxygen, water vapor, dust, etc. A further objective of most types of packaging is to contain or agglomerate the contents being packaged. For example, small objects are typically grouped together in one package for reasons of efficiency. Additionally, some items such as liquids, powders, and granular, materials need containment.

Plastic packaging is used to achieve many of these objectives. For example, plastic sheeting can be used to form plastic bags that can serve a wide range of purposes. However, the plastic bags that are formed from the plastic sheeting are generally created by a heat sealing process that seals the bag closed once the items to be packaged are placed in the bag. The heat seal method can be cumbersome and depending on the items being packaged, the heat used to seal the bags can disturb the contents therein. This is especially true for individual packages that are custom made to different sized items such that the packages are made around the item.

In some types of packaging, the packages are formed by placing a base air permeable substrate on a vacuum box and a product is placed on this air permeable substrate and a heated sheet of film is lowered over top of the product being packaged and the air permeable substrate. Air is pulled through the substrate to form a vacuum sealed package. In such packages all the air may not be removed. In some types of packaging, two sheets of film can be used to form a vacuum-sealed package. In such packages, a vacuum chamber is used where a base film is placed in the chamber and a product is placed on the base film. Air is removed from the chamber and the top film sheet is lowered and secured to the base film within the chamber with seals around the perimeter, thereby forming a package in a vacuum. These vacuum packaged products and packages formed in a vacuum allow for items inside the packaging to be preserved longer due to the absence of air within the packaging. While these vacuum sealed packages and packages formed in a vacuum are beneficial to provide air tight packing that can preserve the contents within the package longer, there are still issues related to these packaging systems. For the current vacuum sealed packages with an air permeable base substrate, air may not be fully removed from within the package. In the case of a package sealed in a vacuum, expensive equipment such as a vacuum chamber is needed.

Therefore, a need exists for packaging sheets and material that can be sealed easily to form vacuumed sealed packages with air being removed from within the package and that provides a permanent bond.

SUMMARY

It is an object of the present disclosure to provide novel packaging film sheets with dimples therein, templates for making, the dimpled film sheets and related methods of making and using. More specifically, the subject matter disclosed herein relates to packaging sheets that are dimpled having raised, portions with valleys around the raised portions to provide a dimpled film sheet that can be used to create an air tight seal in a vacuum sealed package. Templates for forming the vacuum sealed materials are also provided as are methods for using the template and manufacturing the dimpled films.

While a few objects of the presently disclosed subject matter have been stated hereinabove, which can be achieved in whole or in part, by the presently disclosed subject matter, other objects will become evident as the description proceeds when taken in connection with the accompanying drawings as best described hereinbelow.

BRIEF DESCRIPTION OF THE DRAWINGS

A full and enabling disclosure of the present subject matter to one of ordinary skill in the art is set forth more particularly in the remainder of the specification and in the other documents, pictures and figures attached herewith, including reference to the accompanying figures in which.

Figure 1A:
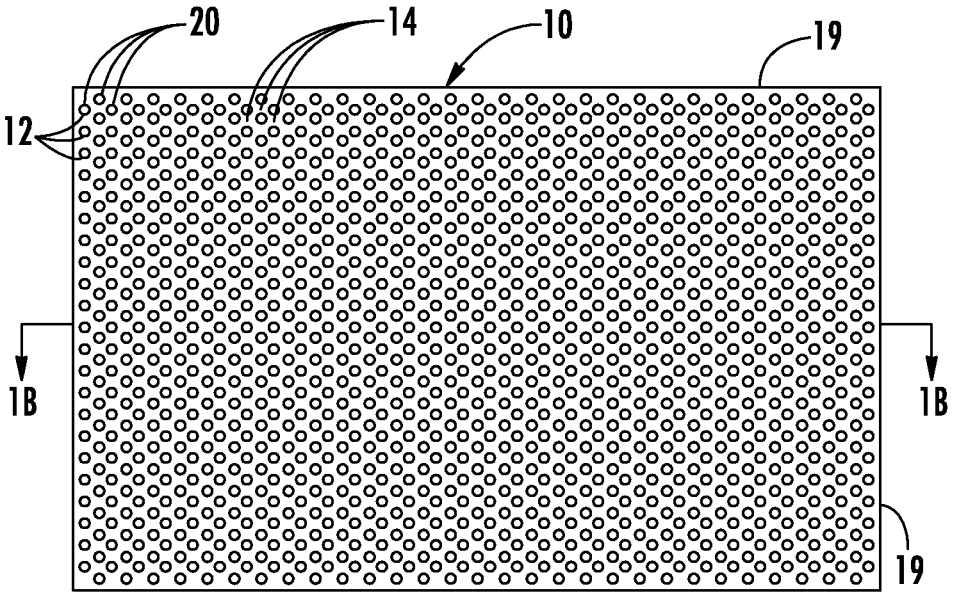
FIG. 1A illustrates a schematic top plan view of an embodiment of a dimpled film packaging sheet according to the subject matter disclosed herein.

Repeat use of reference characters in the present specification and drawings is intended to represent the same or analogous features or elements of the invention.

DETAILED DESCRIPTION

Reference will now be made in detail to the description of the present subject matter, one or more examples of which are shown in the pictures and figures. Each example is provided to explain the subject matter and not as a limitation. In fact, features illustrated or described as part of one embodiment may be used in another embodiment to yield still a further embodiment. It is intended that the present subject matter cover such modifications and variations.

Although the terms first, second, right, left, front, back, etc. may be used herein to describe various features, elements, components, regions, layers and/or sections, these features, elements, components, regions, layers and/or sections should not be limited by these terms. These terms are only used to distinguish one feature, element, component, region, layer or section from another feature, element, component, region, layer or section. Thus, a first feature, element, component, region, layer or section discussed below could be termed a second feature, element, component, region, layer or section without departing from the teachings of the disclosure herein.

Similarly, in the present disclosure, when a feature, element, component, region, layer and/or section is being described as "top", "bottom," "front," "rear," "side," etc., it should be understood that such terms are relative and not absolute. Thus, something that is described with the adjective of "top" may also be considered on a side or a bottom depending on the orientation of the larger subject being described. Additionally, when a feature, element, component, region, layer and/or section is being described as "under," "on," or "over" another feature, element, component, region, layer and/or section, it is to be understood that the features, elements, components, regions, layers and/or sections can either be directly contacting each other or have another feature, element, component, region, layer and/or section between them, unless expressly stated to the contrary. Similarly, directional movement, such as "back and forth," "forward," "backward," "up," "down," or the like are to be understood as relative descriptions that can change depending on the orientation of the subject matter relative to the viewer. Thus, these terms are simply describing the relative position of the features, elements, components, regions, layers and/or sections to each other and do not necessarily mean an absolute position or direction since the relative position above or below depends upon the orientation of the subject matter to the viewer.

Embodiments of the subject matter of the disclosure are described herein with reference to schematic illustrations of embodiments that may be idealized. As such, variations from the shapes and/or positions of features, elements or components within the illustrations as a result of, for example but not limited to, user preferences, manufacturing techniques and/or tolerances are expected. Shapes, sizes and/or positions of features, elements or components illustrated in the figures may also be magnified, minimized, exaggerated, shifted or simplified to facilitate explanation of the subject matter disclosed herein. Thus, the features, elements or components illustrated in the figures are schematic in nature and their shapes and/or positions are not intended to illustrate the precise configuration of a packaging sheet, packaging, material and/or methods of making or using the same and are not intended to limit the scope of the subject matter disclosed herein.

"Adhesive" or "adhesives" as used herein means substances that are used to secure materials, such as substrates, together by binding or adhering to the materials with which they come in contact and resist separation of the materials even under force. Thus, adhesives are substances that have the ability to secure together non-similar materials or substances by binding and/or adhering to the non-similar materials or substances.

"heat-sensitive adhesives" as used, herein means adhesives that can have binding or adhesion or enhanced binding or adhesion to non-similar materials or substances when exposed to a level of heat that activates the adhesive.

"Packaging material" as used herein means one or more items or materials are used to create packages and that can be packed or bundled together or processed in some manner to form a unit for transport.

"Heat distortion temperature" as used herein means a temperature at which a tightly drawn or taut film sheet that is heated begins to stretch and/or sag under its own weight.

Figure 1B:
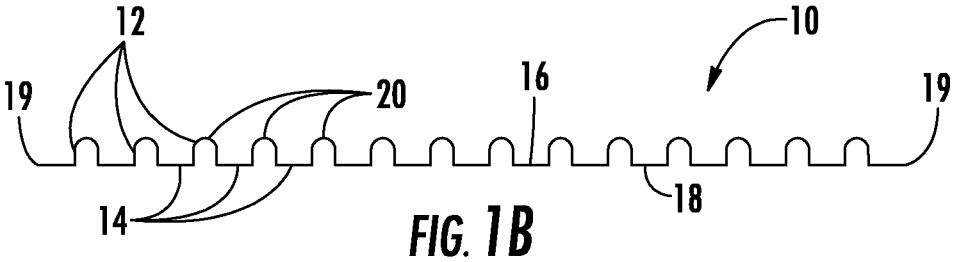
FIG. 1B illustrates a schematic cross-sectional view of the embodiment of the dimpled film packaging sheet taken along lines 1B-1B according to FIG. 1A.

Referring to FIGS. 1A and 1B, an embodiment of a film sheet 10 that has a dimpling 20, or a dimpled film sheet as used herein is shown from a top view. This dimpled film sheet 10 can have a perimeter 19 and raised portions in the form of dimples 12 that rise above valley portions 14 of the film to form the dimpling 20. The raised portions 12 can form different patterns on the film sheet 10 that can be symmetrical or nonsymmetrical in nature. As shown in in the cross-sectional view of FIG. 1B, the raised portions 12 do not form a bubble with a film underneath the raised portions 12 but merely a portion of the film 10 that extends upward from the valley portions 14 of the film 10.

The film 10 can have a first side 16 from which the raised portions 12 extend and a second side 18 opposite the first side 16. In some embodiments, the first side 16 of the dimpled film 10 can be coated with an adhesive. For example, the adhesive can be a heat-sensitive adhesive that is activated when the film or the adhesive on the film is heated to an activation temperature. Thus, in some embodiments, the dimpling 20, i.e., the raised portions or dimples 12 are formed on the coated side 16 of the film 10. In some embodiments, the dimpled film 10 is not coated with an adhesive.

The film that can be used to form the dimpled film sheet can be various polymer thermoplastic material that can form an air impermeable film. For example, in some embodiments, the film can be a polyester, a polyolefin, or a polyethylene. In some embodiments, the film can be Surlyn® by Dupont®.

Figure 2A:
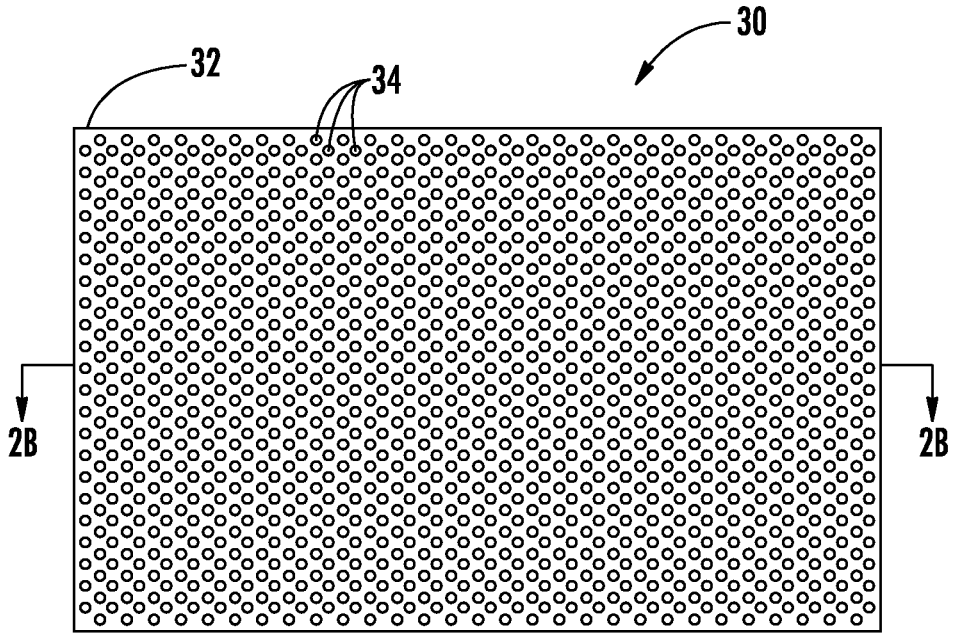
FIG. 2A illustrates a top plan view of an embodiment of a template used to form a dimpled film according to the subject matter disclosed herein.
Figure 2B:
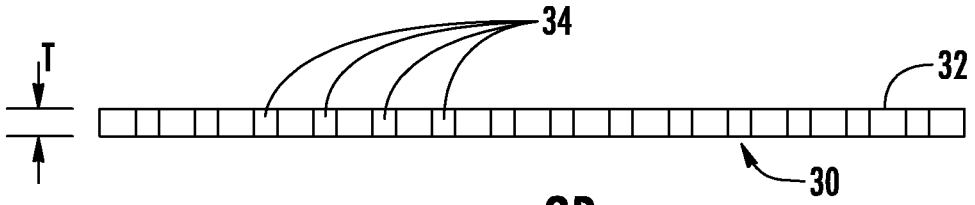
FIG. 2B illustrates a schematic cross-sectional view of the embodiment of the template used to form a dimpled film taken along lines 2B-2B according to FIG. 2A.

The dimpled films 10 can be formed by using a template 30 as shown in FIGS. 2A and 2B. The template 30 can have a body 32 in which apertures 34 are formed therein. For example, the template 30 can be a plate having a thickness T with the apertures 34 formed therein, for example, bored or drilled therethrough. The template 30, for example, can be a metal plate in some embodiments, such an aluminum plate, a stainless-steel plate, a steel plate, a titanium plate, or the like. The thickness T of the template 30 can vary and can depend on the expected or desired height of the dimpled/raised portions 12 of the film 10. In some embodiments, the thickness T of the template 30 can be between about ⅛ of an inch and about ½ of an inch. For example, in some embodiments, the thickness T can be about 3/16 of an inch. Additionally, the template 30 can have various sized apertures 34 as well as various shaped apertures as will be explained further below.

Figure 3:
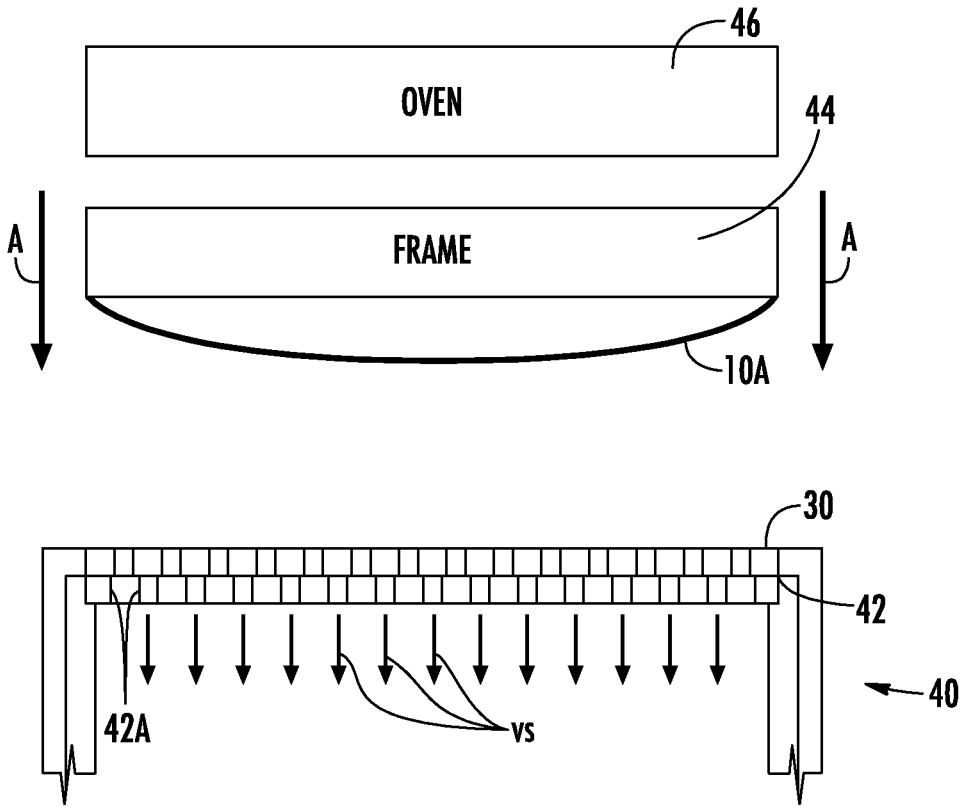
FIG. 3 illustrates a schematic cross-sectional side view of an embodiment of a dimpled film forming system including an embodiment of a vacuum box and a template according to the subject matter disclosed herein.

As shown in FIG. 3, a dimpled film can be made using a template on a vacuum box. For example, a template 30 can be placed on a vacuum box 40. The vacuum box 40 can have a base plate 42 with apertures therethrough through which air, i.e., vacuum suction, VS is pulled by, a vacuum mechanism. A sheet of film 10A can be secured in a clamp frame 44. The clamp frame 44 can be movably positioned near an oven 46 that can be used to heat the film sheet 10A to a temperature at or near its transition temperature or heat distortion temperature. Upon the heating of the film, the clamp frame 44 can be moved downward in direction A onto the template 30. Once the heated, film 10A is lowered onto the template 30, the vacuum suction VS created by the vacuum box 40 can pull the heated film sheet 10A covering the apertures 34 in the template 30 into the apertures 34 to form the dimples, i.e., the raised portions in the heated film sheet 10A in apertures 34 in the template 30. The heated film sheet 10A is stretched at these suctions points to form the dimples. Due to the temperature of the film sheet 10A, the film is more stretchable and can be set in the shape that the film sheet is in as it cools.

Thus, for example, the template 30 is placed in the vacuum box 40 of a standard skin packaging machine and run in a cycle with the heated film 10A thereon to produce the dimples in the film 10A to form a dimpled film sheet (as shown in FIGS. 1A and 1B) upon cutting the film, sheet 10A to its desired size or perimeter. The vacuum pulls the film 10A so that the film stretches into the apertures 34 in the template 30 to form the dimples/raised portions 12 of dimpled film sheet 10 as shown in FIGS. 1A and 1B. The cycle of the vacuum causes the stretch of the film sheet 10A at the apertures 34 in the template 30 to be permanent as the temperature of the film sheet 10A cools. Once the vacuum has run, the film sheet formed with dimples can be cut into dimpled film sheets 10. Once the dimpled film sheet is formed, it can be used to form an air-tight package for products or items to be packaged.

FIGS. 4A-4E illustrates a schematic cross-sectional side view of a package forming process using the dimpled film as shown in FIGS. 1A and 1B and described above. A dimpled film sheet 10 can be placed on an apertured base plate 42 of a vacuum box 40, in a correct position, with the protrusions or dimples 12 extending or facing upward from the valleys 14 of the dimpled film sheet 10 in a direction towards the heat source 46 and an item to be packaged can be placed on the dimpled film sheet 10. In such embodiments in which the dimpled film sheet is coated on one side with an adhesive, the dimpled film sheet 10 can be placed on the base plate 42 of the vacuum box 40 with coated side 16 facing upward. The dimpled film can be cut to a shape that is smaller than the base plate 42 of the vacuum box 40 to permit the dimpled film sheet 10 to be placed on the base plate 42 so that the base plate 42 is exposed around the perimeter of the dimpled film sheet 10 to provide a clearances represented by $D_1$ and $D_2$ through which air is pulled.

Clearances $D_1$, and $D_2$ can be the same or different. Further, the clearances can vary in size. The shape of the dimpled film sheet 10 can vary in sizes such that the perimeter 19 can provide different clearances for different packages. The clearances can aid in controlling the air flow of the vacuum suction VS above the dimpled film sheet 10 that the vacuum 48 creates between the top film sheet 50 and the dimpled film sheet 10. For example, for some packages, the clearances $D_1$ and $D_2$ can be about % inch to about 4 inches. For some packages, the clearances $D_1$ and $D_2$ can be about an inch. In some embodiments, the clearances $D_1$ and $D_2$ can be about 1 inch. For example, a smaller area created by the clearances $D_1$ and $D_2$ where apertures 42A are exposed can decrease the vacuum suction VS between the top film sheet 50 and the dimpled film sheet 10. Similarly, a larger area created by the clearances $D_1$ and $D_2$ where apertures 42A are exposed can increase the vacuum suction VS between the top film sheet 50 and the dimpled film sheet 10. In this manner, the vacuum suction VS between the top film sheet 50 and the dimpled film sheet 10 by selecting a properly sized dimpled film sheet 10 having a desired perimeter 19. Once the dimpled film sheet 10 is properly placed on the base plate 42 of the vacuum box 40, the item P to be packaged can then be placed on the dimpled film sheet 10 on top of the dimples 12. Thus, a dimpled film sheet 10 that can be produced by the vacuum box 40 as described above can be placed on the top surface 42B of a base plate 42 of the vacuum box 40 in a correct position, with the protrusions or dimples 12 extending or facing upward from the top surface 42B in a direction towards the heat source 46 and an item P can be placed on the dimpled film sheet 10.

Figure 4A:
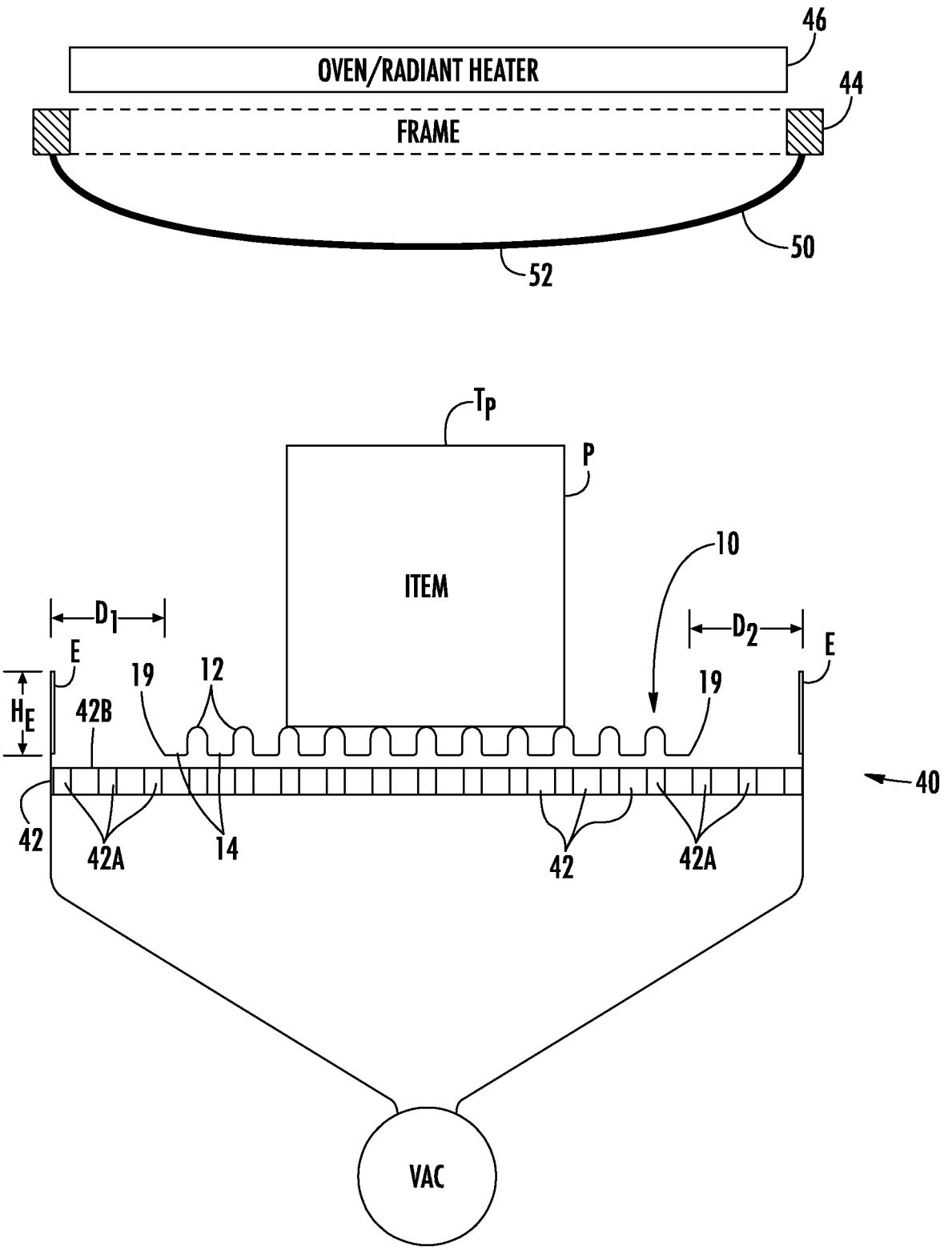
FIGS. 4A-4E illustrate a schematic side views of a top film sheet being placed over an embodiment of a dimple filmed sheet to form a package on a vacuum packaging machine according to the subject matter disclosed herein.

As shown in FIG. 4A, a top film sheet 50 that has been secured in a clamp frame 44 such that it is tightly, drawn or taut within the clamp frame and that has been heated to a processing temperature, such as heat distortion temperature were the top film sheet 50 begins to stretch under its own weight, by a radiant heat source, such as an oven, 46 can be lowered over item P and the dimpled film sheet 10. For example, with the clamp frame 44 at the bottom position (not shown), a top film sheet 50 placed in the clamp frame 44 and secured tightly drawn or taut within the clamp frame 44. The clamp frame 44 can then be moved to an upward position as shown in FIG. 4A near the heat source 46, such as a radiant heat source, to a stopped position.

Like the dimpled film sheet 10, the top film sheet 50 can be various polymer thermoplastic material that can form an air impermeable film. For example, in some embodiments, the film can be a polyester, a polyolefin, or a polyethylene. In some embodiments, the film can be Surlyn® by Dupont®. The thickness of the top film sheet and the thickness of the dimpled film sheet can be the same or different. For example, in some of the embodiments, the thickness of the top film sheet can be greater than the thickness of the dimpled film sheet. In some embodiments of the packaging system, the raised portions 12 of the dimpled film sheet 10 can be thinner than the thickness of the top film sheet 50. In some embodiments, a first side 52 of the top film sheet 50 can be coated with an adhesive. For example, the adhesive can be a heat-sensitive adhesive that is activated when the film sheet 50 or the adhesive on the film sheet 50 is heated to an activation temperature. Thus, in some embodiments, the first side 52 of the top film sheet 50 that can be coated will face and come in contact with the dimpled film sheet 10 after the top film sheet 50 is heated and the heat-sensitive adhesive on the coated side 52 of the top film sheet 50 is activated such that the top film sheet 50 adheres to, the dimpled film sheet 10. In some embodiments, the top film sheet 50 does not have an adhesive coating thereon.

When the clamp frame 44 is at the upper position as shown in FIG. 4A, the heat source 46 is activated to heat the film sheet 50 in the clamp frame 44 that is to be the top film sheet 50 of the package. When the film sheet 50 reaches a heat distortion temperature where it begins to sag under its own weight about an inch under the frame, the clamp frame moves downward toward the item P and the dimpled film sheet 10 upon which the item P is placed. This heat distortion temperature can vary depending on the type of thermoplastic film that is used as the top film sheet 50.

Figure 4B:
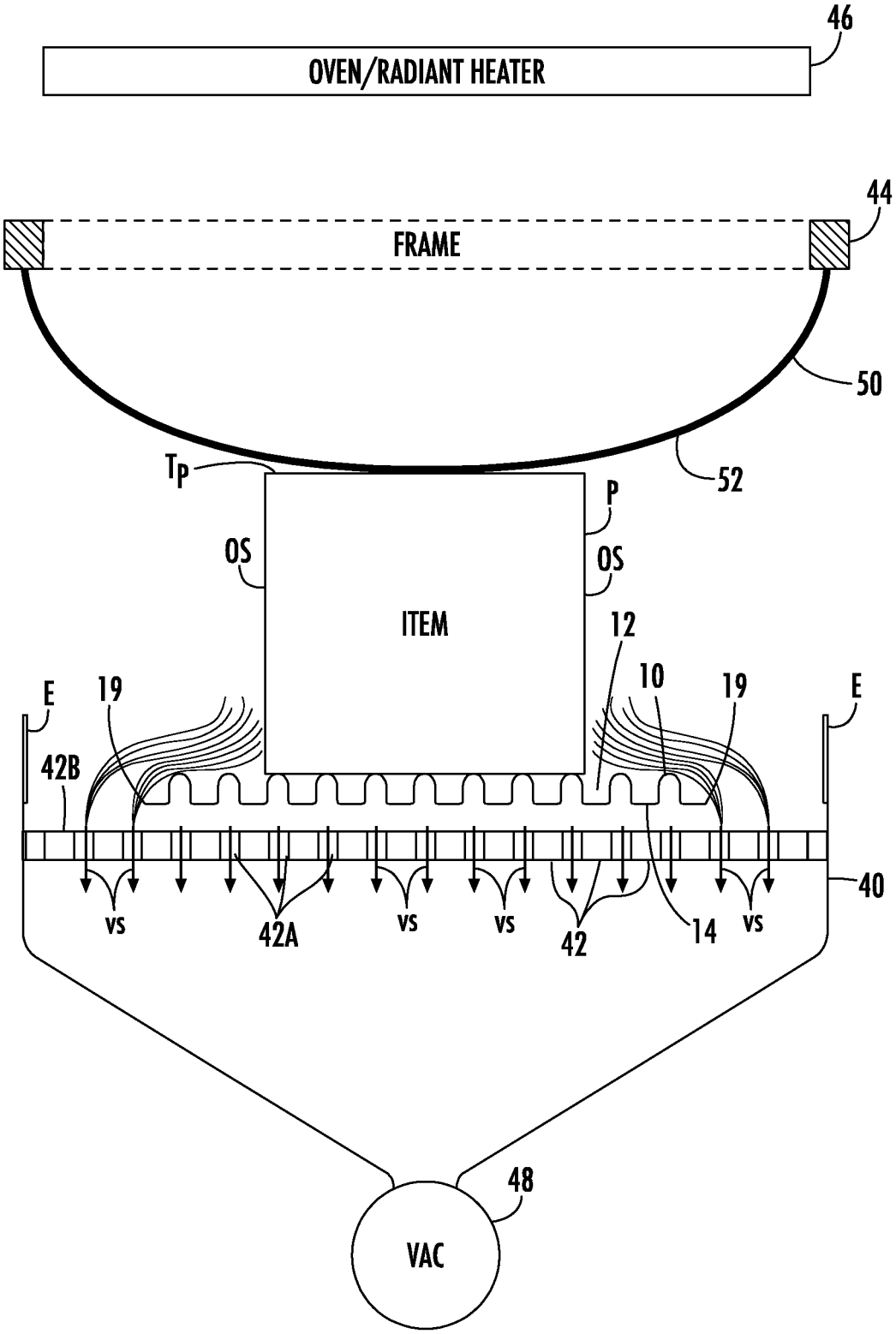

Referring to FIG. 4B, the vacuum 48 is engaged to draw air or vacuum suction VS as the top film sheet 50 touches a top surface $T_p$ of the item P being packaged to remove air from between the top film sheet 50 and the item P as the clamp frame 44 continues downward pulling of the top film sheet 50 around and covering the item P as all air is removed such that the top film sheet 50 is pulled down against the item P at a base of the item that rests on the dimpled film sheet 10. From the point of contact of the top film sheet 50 to the outer edge of the top surface $T_p$ of the item P, a barrier is formed around the top surface $T_p$ to the top perimeter edge of the item P as the vacuum suction VS from the vacuum box 40 is being applied.

Figure 4C:
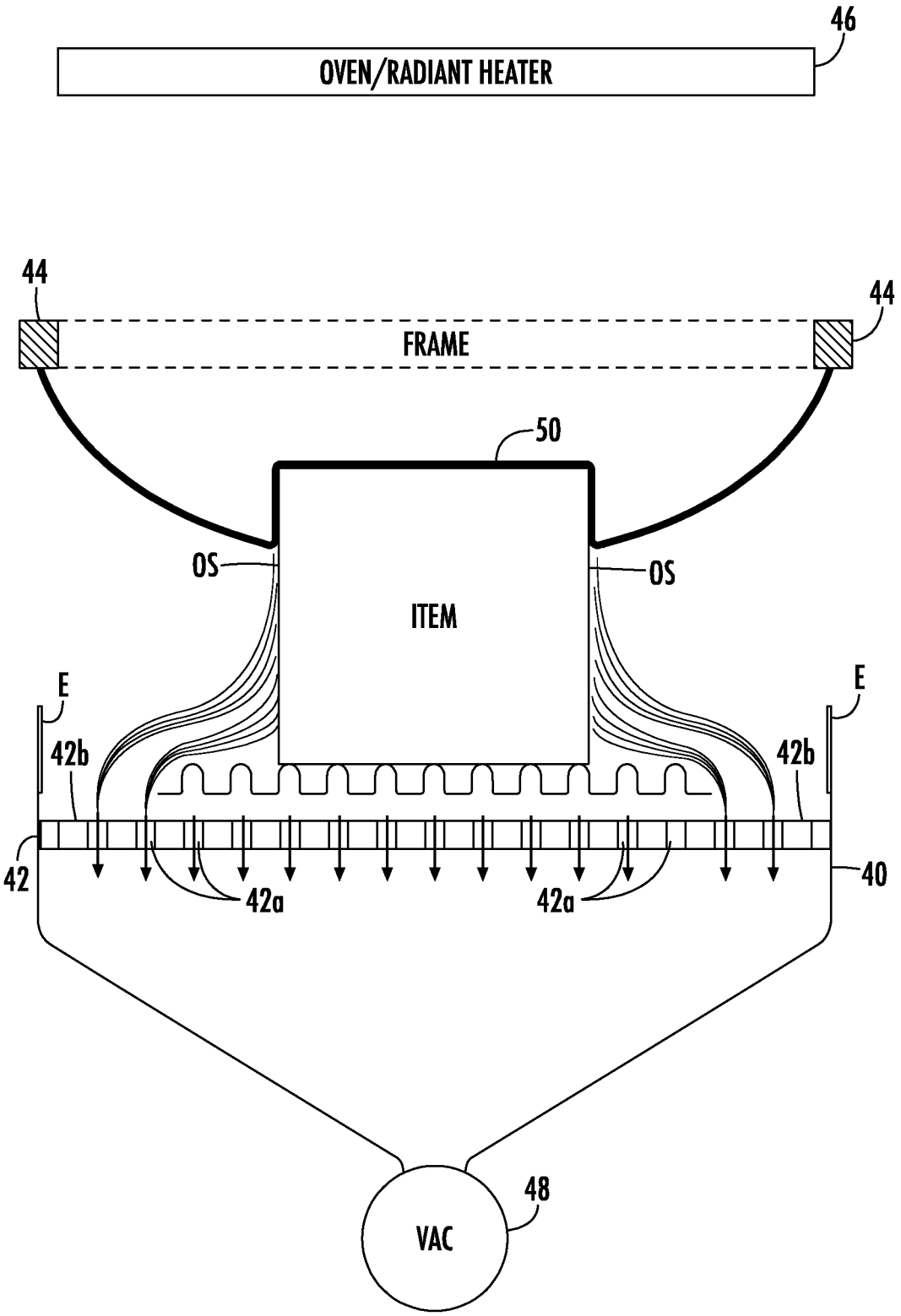

As shown in FIG. 4C, the vacuum suction VS from the vacuum box 40 continues to draw air as the clamp frame 44 continues its downward, pulling of the top film sheet 50 around the item P as all air is removed such that the top film sheet 50 is pulled down against the item P along side outer surfaces OS of the item P. As the heated top film sheet 50 is lowered onto the product P and the dimpled film sheet 10, the vacuum 48 pulls air VS through the valley portions 14 around the raised portions 12 of the dimpled film, sheet 10 and out around the perimeter 19 of the dimpled film sheet 10 through the apertures 42A of the apertured base plate 42 of the vacuum box 40. The vacuum suction VS from the vacuum 48 of the vacuum box 40 is now operating to hold the dimpled filmed sheet 10 against the surface 42B of the apertured base plate 42 of vacuum box 40 on the bottom area 18 of the dimpled film sheet 10. The area of the apertured base plate 42 around the perimeter 19 of the dimpled film sheet 10 is not covered by the dimpled film sheet 10 as described above. This area, of the apertured base plate 42 that is not covered allows the vacuum 48 from vacuum box to pull air VS from above the dimpled film sheet 10 and through the valleys 14 of the dimpled film sheet 10. This area is adjustable based on the size of the dimpled film sheet 10 chosen to form the package base on its perimeter 19 as described above.

As the clamp frame 44 moves downward, air between the top film sheet 50 and the outer surface OS of the sides of the item P being packaged is removed to force the hot top film sheet 50 against the outer side surfaces OS of the item P. Once the clamp frame 44 reaches the outer raised edge E of the vacuum box 40 which is above a top surface of the dimpled film sheet 10 as shown in FIG. 40, the volume between the top film sheet 50, the dimpled film sheet 10 and the base plate 42 is closed and the vacuum continues to pull air VS from around the item P and the air is continued to be removed between the outer side surfaces OS of the item P and the top film sheet 50 such that the top film sheet 50 resides against the item P until the top film sheet 50 reaches a base perimeter BP on the dimpled film sheet 10 where a base B of the item P resides against the top of the dimpled film sheet 10.

Figure 4D:
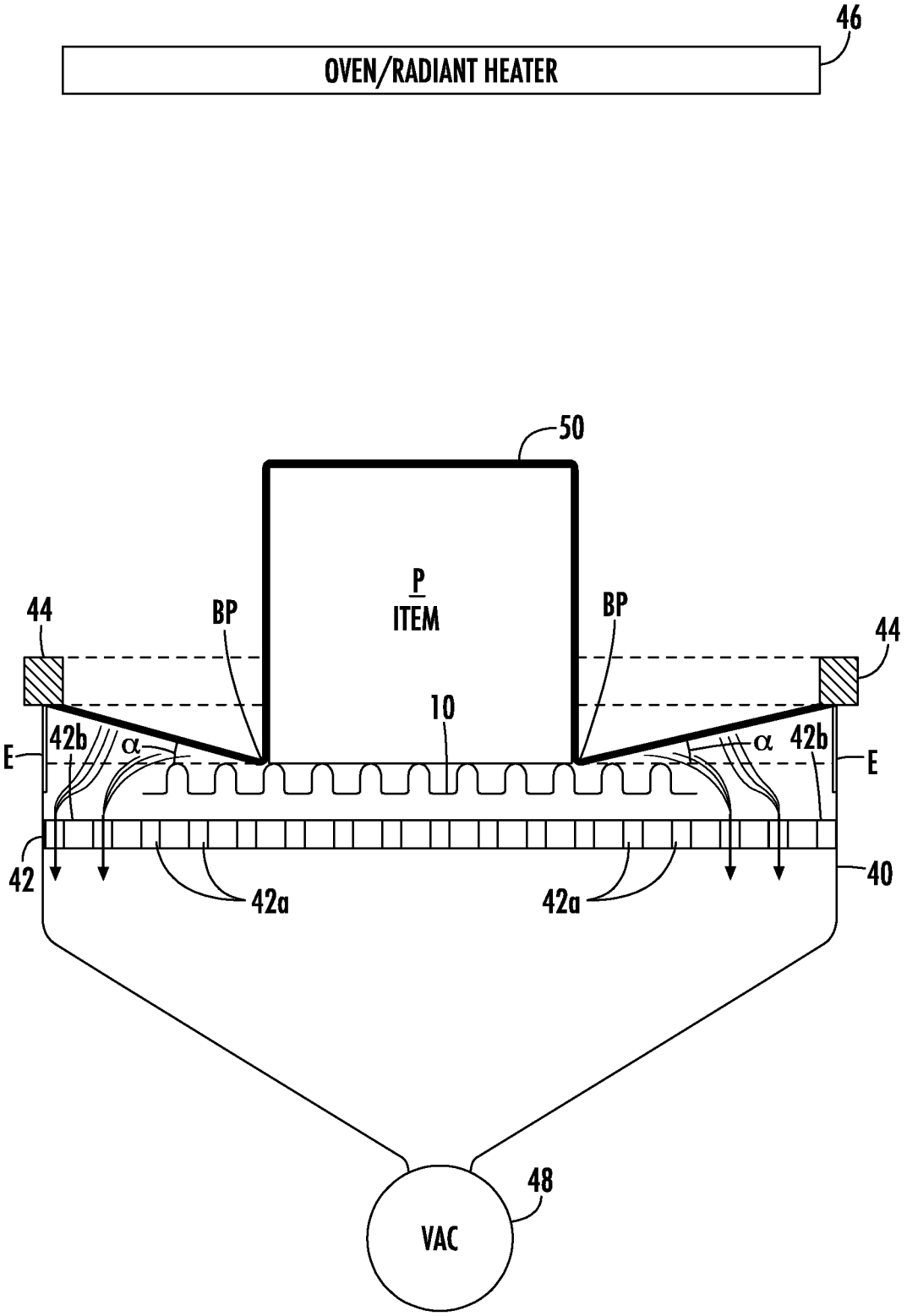

Air is removed from between the bottom surface of the item P and the top surface of the dimpled film sheet 10 as the top film sheet 50 is being pulled down to the top surface of the protrusions 12 at the base perimeter BP. Referring to FIG. 4D, as the top film sheet 50 is being pulled down to the top surface of the dimples 12 of the dimpled film sheet 10, the raised edges E of the vacuum box 40 that extend above the base plate 42 hold the outer perimeter edges of the top film sheet 50 above the dimpled film sheet 10 such that the remainder of the top film sheet 50 from the base perimeter BP at the dimpled film sheet top surface extending outward to the perimeter of the top film sheet 50 in the clamp frame 44 extends at an angle $\alpha$ that is equal to or greater than about 5°. For example, the frame and/or top film sheet 50 can come to rest on an raised edge E that causes the top film sheet 50 to extend at about a 5° to about a 30° angle from the base perimeter BP against the upper portions of the dimpled film sheet 10 at the base B of the item P to the raised edge E of the vacuum box 40 where the clamp frame 44 and/or top film sheet 50 comes to rest.

The top film sheet 50 extending upward from the base perimeter BP prevents portions of the top film sheet 50 from prematurely contacting, the dimpled film sheet 10 outward from the base perimeter BP near the top film sheet perimeter 59 which could hinder or prevent removal of air from the package as it is being formed.

Figure 4E:
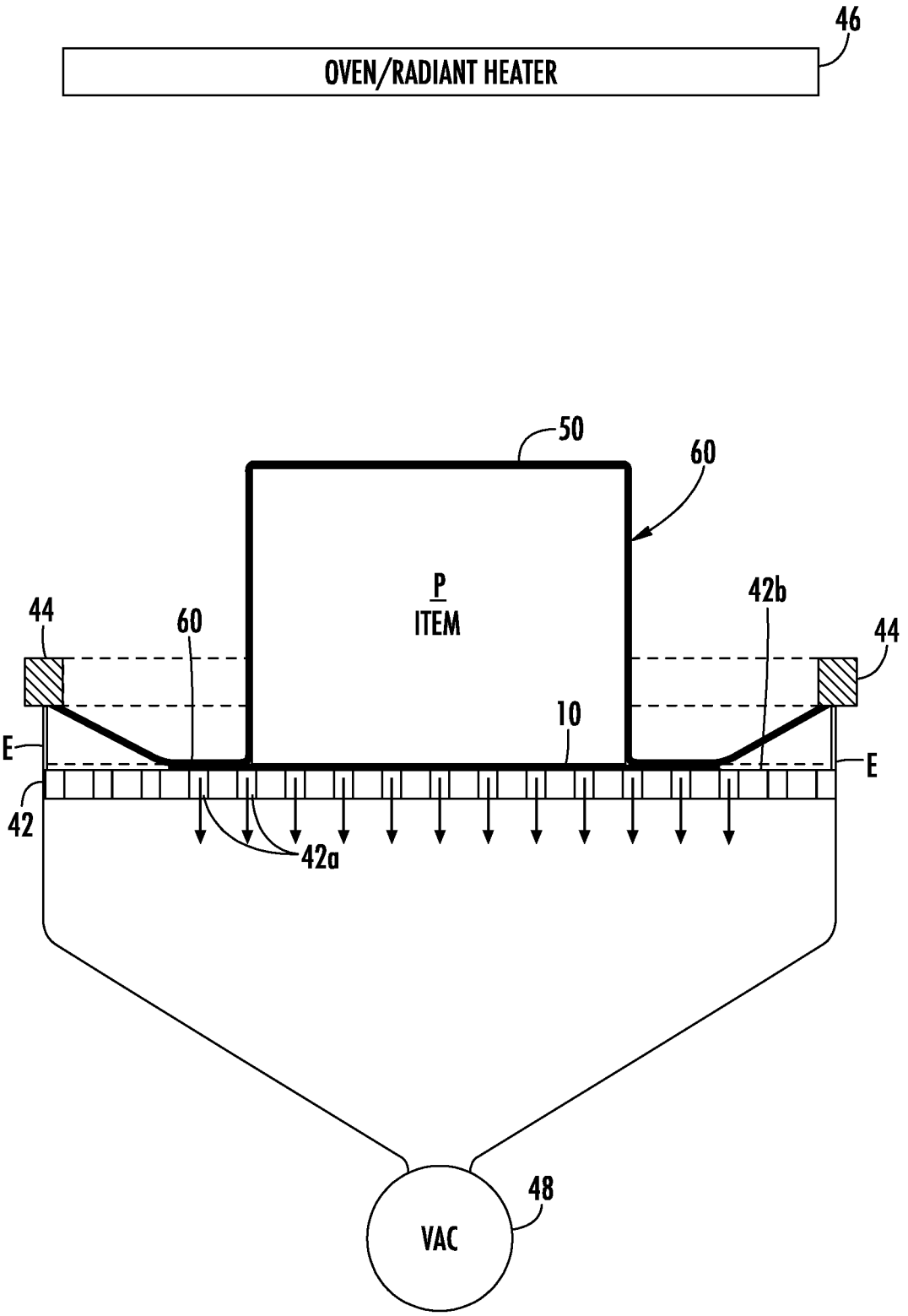

As shown in FIG. 4E, once the top film sheet 50 is pulled down by the vacuum to the base perimeter BP around the base B of the item P, the vacuum suction VS works to pull down the top film sheet 50 down against the dimpled film sheet 10 from, the inward position of the base perimeter BP to the outer perimeter 19 of the of the dimpled film sheet 10, such that the top film sheet 50 seals to the dimpled film sheet 10 from an inward position to an outward position to reduce or eliminate the possibility of trapping air within the package as it is sealed.

As the hot top film sheet 50 is pulled down toward the dimpled film sheet 10 at the base perimeter BP and contacts the top surface of the dimples 12 in the dimpled film sheet 10, thermal heat transfer occurs from the top film sheet 50 to the dimples 12 of the dimpled film sheet 10, collapsing the dimples and bring the hot top film sheet 50 in contact against the valleys 14 of the dimpled film sheet 10 to create and air-tight seal. The collapsing of the dimples 12 in combination with the vacuum suction VS can pull the top film sheet 50 into closure with the collapsed dimple forming sealing structures, such as sealing rings that, add strength to the seal between the top film sheet 50 and the dimpled film sheet 10 as described in further detail below.

Thus, as shown in FIG. 4E, upon the clamp frame 44 reaching the raised edges E of the vacuum box 40 around the perimeter of the base plate 42, a chamber is created that limits or eliminates air flow from outside the chamber into the chamber and the vacuum suction VS can increase within the vacuum box 40 to create more negative pressure within the sealed chamber to collapse the rest of the dimples, or protrusions, 12 and laminating the top film sheet 50 and the dimpled film sheet 10 together to form a rough package. The heated dimples 12 collapse as the top film sheet 50 is pulled down. The vacuum at the clearance areas between the perimeter edges of the dimpled film sheet 10 and the edges of the base plate 42 of the vacuum box 40 continues until all the raised portions/dimples 12 of the dimpled film sheet 10 have collapsed, thereby vacuuming all air out of the space between both the sheets of film 50 and 10, and thereby forming a vacuumed sealed package 60 around the item P. As the heated top film sheet 50 contacts the top sections of the raise portions 12 of the dimpled film sheet 10, heat is transferred from the top film sheet 50 to the dimpled film sheet 10 and the corridors formed between the raised portions 12 of the dimpled film sheet 10 and the top film sheet 50 are formed by the valley portions 14 of the dimpled film sheet 10 through which air within the package being formed is quickly removed. While not wanting to be held to any particular theory of operation, it is believed that this heat transfer from the heated top sheet 50 at the raised portions 12 and the formation of the air removing corridors aid in the collapsing of the raised portions 12 to form an air-tight seal between the top film sheet 50 and the dimpled film sheet 10 as the air within the forming package is removed.

If the dimpled film sheet 10 sticks to the vacuum box 40, the air flow can be reversed from a vacuum suction to a blowing air configuration to force separation. This air can also cool the formed package. Thereby, the package can be removed from the vacuum box and can be trimmed to form a finished package. The item P within the finished package 60 can be seen through both sides of the package 60, i.e., through both the top film sheet 50 and, the dimpled bottom sheet 10. Once package 60 is formed, the package 60 can be trimmed around the edges to form a smaller package with the sealed edges closer to the item P. The sealed package 60 is flexible and should have a long shelf life that can be ideal for packaging meat.

Figure 5:
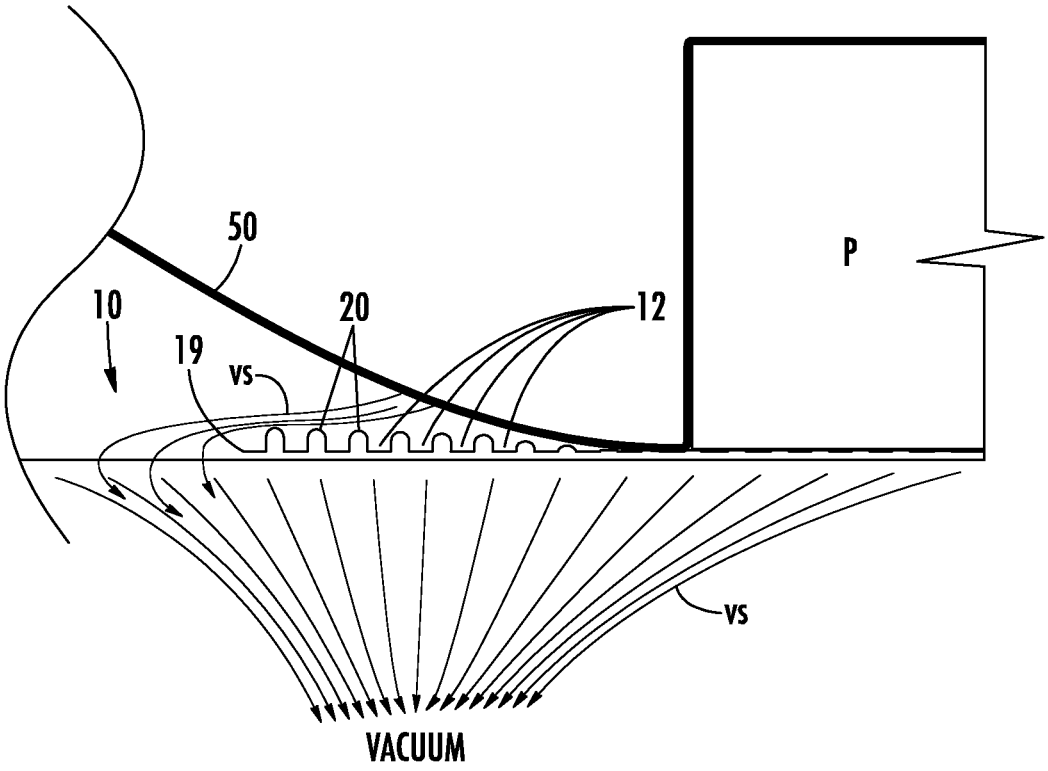
FIG. 5 illustrates a schematic cross-sectional side view of a top film sheet being placed over an embodiment of a dimple filmed sheet to form a package on a vacuum packaging machine according to FIGS. 4A-4C.

To further illustrate a collapsing of a dimpling 20, i.e., raised portions or dimples, 12 of a dimpled film sheet 10 upon contact with a heated top film, sheet 50 as air is being pulled out between the top film sheet 50 and the dimpled film sheet 10 by the vacuum created by a vacuum box (not shown), FIG. 5 is provided. FIG. 5 shows a schematic cross-sectional side view of a top film sheet 50 being pulled down over and item P and onto an embodiment of a dimple filmed sheet 10 by the vacuum of the vacuum box to form a package on a vacuum packaging machine, such as a vacuum box at a base perimeter BP. As can be seen, raised portions 12 of a dimpled film sheet 10 collapse down and bond with the top film sheet 50 to form an air-tight seal for the packaging that can surround an item or product from an inward position at the base perimeter BP to an outer position at the perimeter 19 of the dimple filmed sheet 10. As stated above, the top film sheet 50 can extend at an angle $\alpha$ of between about a 5° to about a 30° as measured from the base perimeter BP between the top surface $T_D$ of the dimpled film sheet 10 and the top film sheet 50 to prevent portions of the top film sheet 50 from prematurely contacting the dimpled film sheet 10 outward from the base perimeter BP which could hinder or prevent removal of air from the package as it is being formed.

Figure 6A:
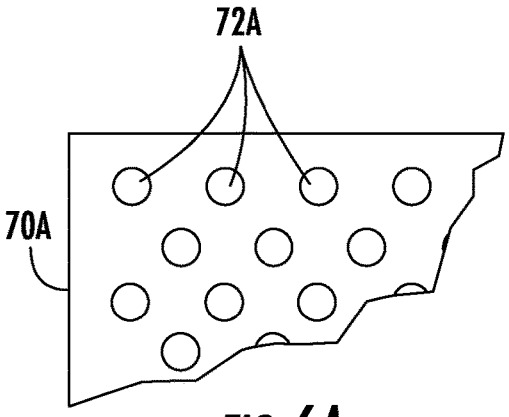
FIGS. 6A, 6B, and 6C illustrate a schematic top plan views of portions of different example embodiments of dimpled film sheets that have different dimple shapes according to the subject matter disclosed herein.
Figure 6B:
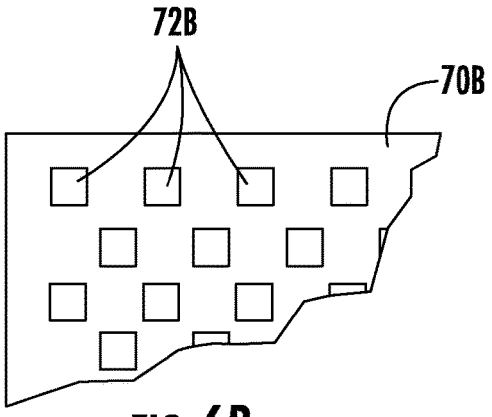
Figure 6C:
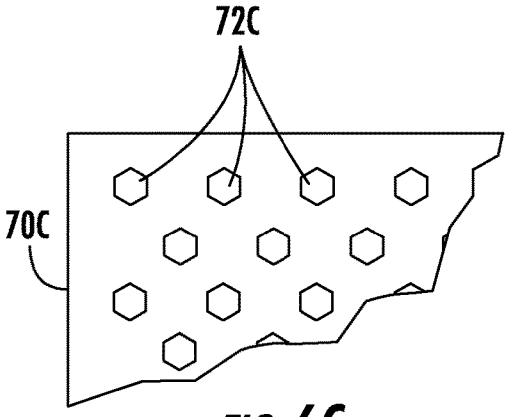

As stated above, the template 30 can have various sized apertures 34 (see FIGS. 2A and 2B) as well as various shaped apertures to form various sized dimpling, or raised portions, on the dimpled film sheets. As shown in FIG. 6A, raised portions 72A of a dimpled film, sheet 70A can have a circular cross-sectional shape. These raised portions 72A can be symmetrically or non-symmetrically positioned on the dimpled film sheet 70A. Similarly, these raised portions 72A on the dimpled film sheet 70A can be the same or different sizes. For example, the circular cross-sections of the raised portions 72A can be have the same or different radii. As shown in FIG. 6B, raised portions 72B of a dimpled film sheet 70B can have a rectangular, or square, cross-sectional shape. As with the circular cross-sectioned raised portions in FIG. 6A, these rectangular, or square, cross-sectional shape raised portions 72B can be symmetrically or non-symmetrically positioned on the dimpled film sheet 70B. Similarly, these raised portions 72B on the dimpled film sheet 70B can be the same or different sizes. As shown in FIG. 6C, raised portions 72C of a dimpled film sheet 70C can have other polygonal cross-sectional shapes, such as a hexagonal shape.

Figure 6D:
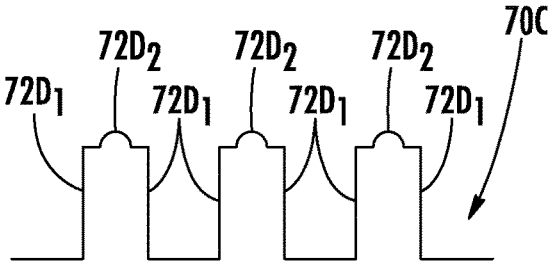
FIG. 6D illustrates a schematic cross-sectional view of a portion, of a different example embodiment of a dimpled film sheet that has different dimple shape according to the subject matter disclosed herein.

In some embodiments as shown in FIG. 6D, a dimpled film sheet 70D can have raised portions 72D that comprise different shapes at different locations along the height of the raised portion 72D. For example, the raised portion 72D can have a base cross-sectional shape 72$D_1$ that is larger than an upper cross-sectional shape 72$D_2$ as shown in FIG. 6D. In some embodiments, the base cross-sectional shape 72$D_1$ can have a different type of cross-sectional shape than the upper cross-sectional shape 72$D_2$. For example, the raised portion 72D can have the base cross-sectional shape 72$D_1$ with, a rectangular cross-sectional shape and the upper cross-sectional shape 72$D_2$ with a circular cross-sectional shape. As stated above, the different shapes, placements and sizes of the raised portions in the dimpled films and dimpled film sheets can be controlled and formed by different templates that can, for example, have apertures with different shapes, placements and sizes within the body of the template.

Figure 7:
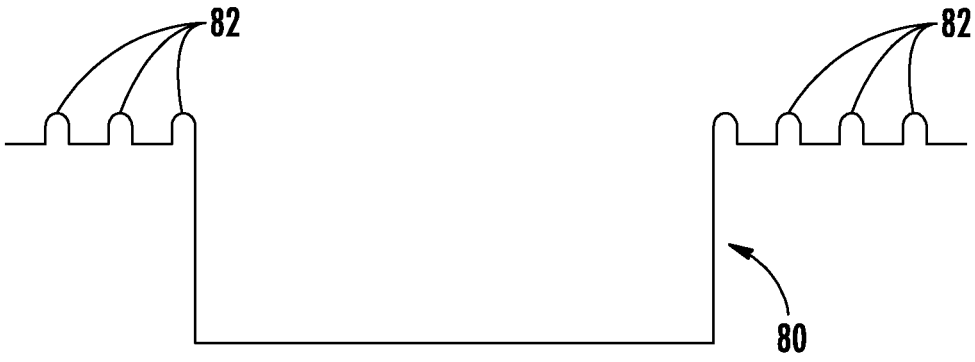
FIG. 7 illustrates a perspective view of an embodiment of a blister packaging sheet that has dimples formed on only the portions that will come in contact with the top film sheet, according to the subject matter disclosed herein.

FIG. 7 illustrates a perspective view of an embodiment of a blister packaging sheet 80 that has dimples 82 formed on only the portions that will come in contact with the top film sheet to form a package to hold a larger or fragile item or product in a manner as described above.

Figure 8A:
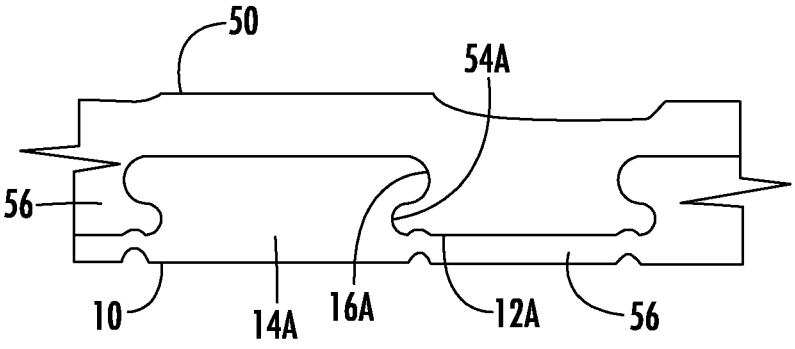
FIG. 8A illustrates a schematic cross-sectional, view of a portion of a package formed according to the present subject matter where a top film sheet is secured to a dimpled bottom film sheet.
Figure 8B:
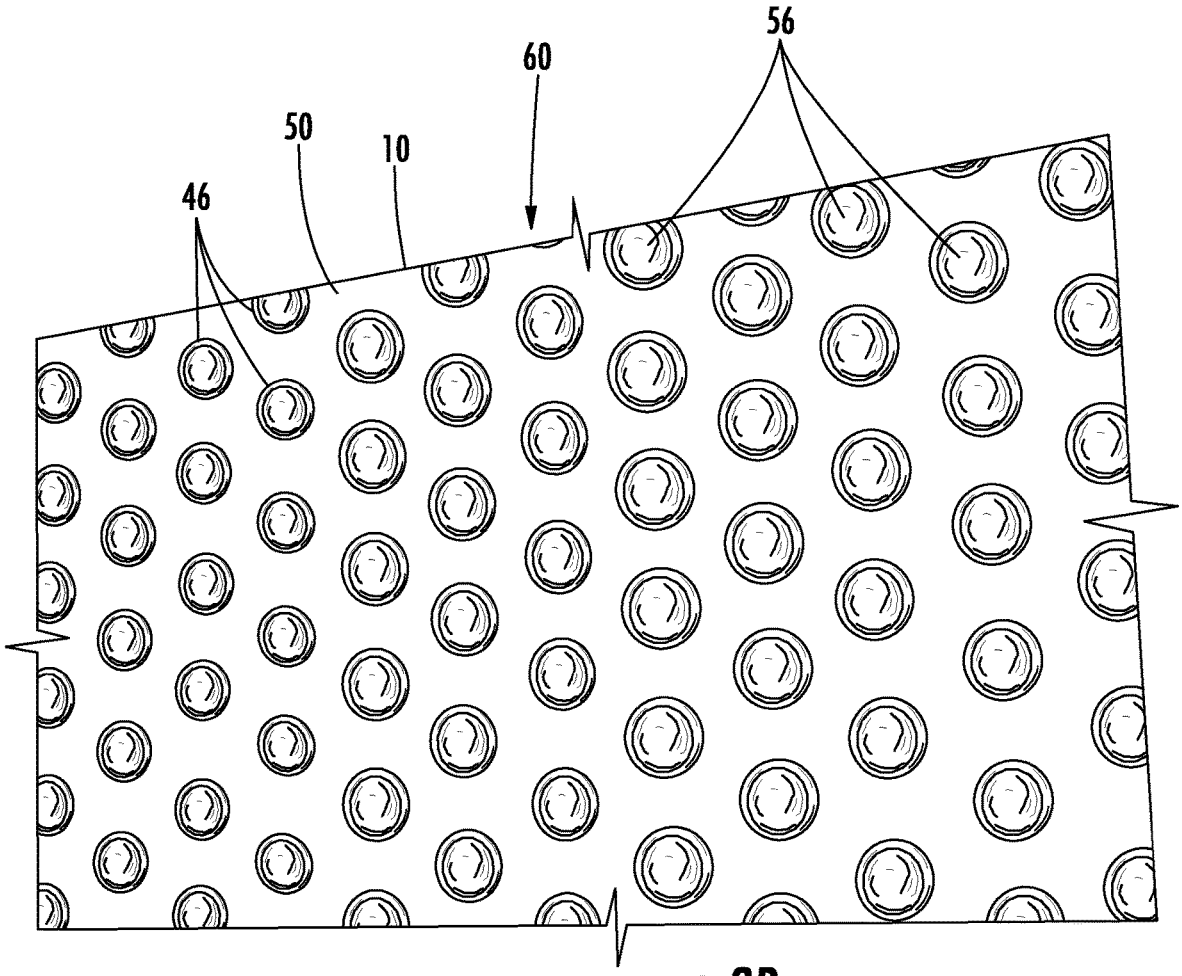
FIG. 8B illustrates a perspective view of the embodiment of portion of a package formed according to the present subject matter where a top film sheet is secured to a dimpled bottom film sheet forming sealing structures, such as sealing rings.

Referring to FIGS. 8A and 8B, to form a robust, strengthened and flexible seal between the top film sheet 50 and the dimpled film sheet 10, the collapsing of the dimples 12 (see FIGS. 1A and 1B) in combination with the vacuum suction VS can pull the top film sheet 50 into closure with the collapsed dimple 12A forming sealing structures, such as sealing rings, 56 that add strength to the seal between the top film sheet 50 and the dimpled film sheet 10. In particular, the protrusions or dimples are collapsing inward and inverting to a small extend at structures 16A at portions 14A where valleys of the dimpled film sheet 10 once were and structures 54A of the top film sheet 50 into the collapsed dimple 12A to form the geometric sealing structures, such as sealing rings 56. These sealing rings 56 can aid in locking the top film sheet 56 to the film sheet 10 that formed the protrusion or dimple. These sealing rings, and/or other geometric sealing structures 56 in the finished laminations can aid in stiffing the finished lamination and can aid in creating an interlocking feature of the film sheets to form package 60.

Thus, methods are disclosed herein for forming vacuum sealed packages. The methods can include providing a vacuum box comprising an apertured base plate and a raised edge around a perimeter of the apertured base plate. A dimpled bottom film sheet comprising dimples and valleys between the dimples and an outer perimeter can be placed on the base plate of the vacuum box. The placement of the dimpled bottom, film sheet can create a clearance area between the outer perimeter of the dimpled bottom film sheet and the perimeter of the apertured base plate. Once the dimpled bottom film sheet is in proper position, an item to be packaged can be placed on the bottom dimpled film sheet. A top film sheet can be secured in a clamp frame above the vacuum box that comprises the apertured base plate with raised edges around the apertured base plate that extend above the apertured base plate. The top film sheet can then be heated to a processing temperature with a heat source that causes the top film sheet to sag under its own weight while in the clamp frame. The clamp frame and heated top film sheet can then be lowered towards the item being packaged and dimpled bottom film sheet. Air can be pulled through the vacuum box creating a vacuum suction when the top film sheet touches a top portion of the product and before the top film sheet touches the dimpled bottom film sheet. The vacuum suction causes the top film sheet to seal against an outer surface of the item being package. The clamp frame can be moved down to the raised edges of the vacuum box as the vacuum suction pulls the top film sheet against the outer surface of the item down to a base perimeter on the dimpled film sheet around a base of the item being packaged such that the remainder of the top film sheet from the base perimeter at the dimpled film sheet top surface extending outward to the perimeter of the top film sheet in the clamp frame extends at an angle that is equal to or greater than about 5°. The top film sheet is pulled down using the vacuum suction into contact with the dimpled film sheet from the base perimeter on the dimpled film sheet outward toward the perimeter of the dimpled film sheet forming a seal between the top film sheet and the dimpled film sheet from the base perimeter outward.

In some such methods, as the hot top film sheet contacts the top surface of the dimples in the dimpled film sheet, thermal heat transfer can occur from the top film sheet to the dimples of the dimpled film sheet. The dimples can collapse and bring the hot top film sheet in contact against the valleys of the dimpled film sheet to create an air-tight seal. The dimples can collapse inward pulling the contacted portion of the top film sheet in with the collapsed dimples to form geometric sealing structures. For example, the geometric sealing structures can be sealing rings. The sealing rings can stiffen the finished laminations to facilitate forming of an interlocking feature of the film sheets.

In some such methods, the angle from the base perimeter against the upper portions of the dimpled film sheet at the base of the item to the raised edge of the vacuum box from which the top film sheet extends can be between about 5° and 30°.

Some such methods can include forming the dimpled film sheet. For example, a template having apertures therein can be placed on the vacuum box and a film sheet can be within the clamp frame. The film sheet can be heated and placed upon the template. Air can then be pulled through the vacuum box creating a vacuum suction causing portions of the film sheet that has been heated to be drawn into the apertures. The film sheet can be cooled to form the dimpled film sheet.

In such methods described above, the top film sheet can comprise a thermoplastic film. For example, the top film sheet can comprise at least one of a polyester, a polyolefin, or a polyethylene. Similarly, the dimpled film sheet can comprise a thermoplastic film. For example, the dimpled film sheet comprises at least one of a polyester, a polyolefin, or a polyethylene.

The methods described above can reversing the vacuum suction to a blowing air in the vacuum box upon completion of the forming of the package to force separation of the formed package from the vacuum box. Such blowing air can cool the package.

In some of the embodiments of the methods described above, the dimples formed in the dimpled film sheet can comprise circular cross-sections. In some of the embodiments of the methods described above, the dimples formed in the dimpled film sheet can comprise at least one of rectangular cross-sections, square cross-sections, or diamond cross-sections.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A method of forming vacuum sealed packages, the method comprising:

providing a vacuum box comprising an apertured base plate and a raised edge around a perimeter of the apertured base plate;

placing a dimpled bottom film sheet comprising dimples and valleys between the dimples and an outer perimeter on the base plate of the vacuum box;

placing an item to be packaged on the dimpled bottom film sheet;

securing a top film sheet in a clamp frame above the vacuum box;

heating the top film sheet to a processing temperature with a heat source that causes the top film sheet to sag under its own weight while in the clamp frame;

lowering the clamp frame and heated top film sheet towards the item and dimpled bottom film sheet;

pulling air through the vacuum box creating a vacuum suction when the top film sheet touches a top portion of the item and before the top film sheet touches the dimpled bottom film sheet causing the top film sheet to seal against an outer surface of the item being packaged;

moving the clamp frame down to the raised edges of the vacuum box as the vacuum suction pulls the top film sheet against the outer surface of the item down to a base perimeter on the dimpled bottom film sheet around a base of the item being packaged such that the remainder of the top film sheet from the base perimeter at the dimpled bottom film sheet top surface extending outward to the perimeter of the top film sheet in the clamp frame extends at an angle that is greater than about 5 degrees; and pulling the top film sheet down using the vacuum suction into contact with the dimpled film sheet from the base perimeter on the dimpled film sheet outward toward the perimeter of the dimpled bottom film sheet forming a seal between the top film sheet and the dimpled bottom film sheet from the base perimeter outward;

collapsing the dimples and bringing the heated top film sheet in contact against the valleys of the dimpled bottom film sheet to create an air-tight seal;

wherein, as the heated top film sheet contacts the top surface of the dimples in the dimpled bottom film sheet, thermal heat transfer occurs from the top film sheet to the dimples of the dimpled bottom film sheet;

wherein the dimples collapse inward pulling the contacted portion of the top film sheet in with the collapsed dimples to form geometric sealing rings;

wherein the sealing rings stiffen the heated top and bottom film sheets to facilitate forming of an interlocking feature of the top and bottom film sheets, respectively.

2. The method according to claim 1, further comprising forming the dimpled film sheet by the steps comprising:

placing a template having apertures therein on the vacuum box;

securing a film sheet within the clamp frame;

heating the film sheet;

placing the film sheet upon the template; and pulling air through the vacuum box creating a vacuum suction causing portions of the film sheet that has been heated to be drawn into the apertures.

3. The method according to claim 1, wherein the top film sheet comprises a thermoplastic film.

4. The method according to claim 1, wherein the top film sheet comprises at least one of a polyester, a polyolefin, or a polyethylene.

5. The method according to claim 1, wherein the dimpled film sheet comprises a thermoplastic film.

6. The method according to claim 1, wherein the dimpled film sheet comprises at least one of a polyester, a polyolefin, or a polyethylene.

7. The method according to claim 1, wherein the dimples formed in the dimpled film sheet comprise circular cross-sections.

8. The method according to claim 1, wherein the dimples formed in the dimpled film sheet comprise at least one of rectangular cross-sections, square cross-sections, or diamond cross-sections.

9. A method of forming vacuum sealed packages, the method comprising:

providing a vacuum box comprising an apertured base plate and a raised edge around a perimeter of the apertured base plate;

placing an item to be packaged on a dimpled bottom film sheet;

securing a top film sheet in a clamp frame above the vacuum box;

heating the top film sheet to a processing temperature with a heat source that causes the top film sheet to sag under its own weight while in the clamp frame;

lowering the clamp frame and heated top film sheet towards the item and dimpled bottom sheet;

pulling air through the vacuum box creating a vacuum suction when the top film sheet touches a top portion of the item being packaged and before the top film sheet touches the dimpled bottom film sheet causing the top film sheet to seal against an outer surface of the item being packaged;

moving the clamp frame down to the raised edges of the vacuum box as the vacuum suction pulls the top film sheet against the outer surface of the item down to a base perimeter on the dimpled film sheet around a base of the item being packaged such that the remainder of the top film sheet from the base perimeter at the top film sheet in the clamp frame extends at an angle that is greater than about 5°;

pulling the top film sheet down using the vacuum suction into contact with the dimpled bottom film sheet from the base perimeter on the dimpled bottom film sheet outward toward the perimeter of the dimpled bottom film sheet forming a seal between the top film sheet and the dimpled bottom film sheet from the base perimeter outward; and reversing the vacuum suction to a blowing air in the vacuum box upon completing the forming of the package to force separation of the formed package from the vacuum box.

10. The method according to claim 9, wherein the blowing air cools the package.

* * * * *